US005868468A

United States Patent [19]

Wang

[11] Patent Number: 5,868,468

[45] Date of Patent: Feb. 9, 1999

[54] CHAIR WITH ADJUSTABLE INCLINATION

[76] Inventor: Chin-Chen Wang, No. 10, Lane 365, Chung Shan S. Rd., Yung Kang City, Taiwan Hsian, Taiwan

[21] Appl. No.: 65,738

[22] Filed: Apr. 24, 1998

[51] Int. Cl.[6] ..... A47C 1/02

[52] U.S. Cl. ..... 297/320; 297/319; 297/300.5; 297/340; 297/300.2; 297/239

[58] Field of Search ..... 297/319, 320, 297/316, 300.1, 300.2, 300.5, 322, 317, 340, 341, 239

[56] References Cited

U.S. PATENT DOCUMENTS

| | | | |
|---|---|---|---|
| 4,756,575 | 7/1988 | Dicks | 297/300.5 |
| 4,830,431 | 5/1989 | Inoue | 297/300.5 |
| 4,986,601 | 1/1991 | Inoue | 297/320 |
| 5,486,035 | 1/1996 | Koepke et al. | 297/340 |
| 5,573,303 | 11/1996 | Doerner | 297/319 |

*Primary Examiner*—Peter M. Cuomo
*Assistant Examiner*—Anthony D. Barfield
*Attorney, Agent, or Firm*—Charles E. Baxley, Esq.

[57] ABSTRACT

A chair includes an L-shaped backrest with a horizontal section engaged with an underside of a seat. An elongated slot is defined in an underside of the horizontal section. A spring assembly includes a knob with a screw extending through the elongated slot and threadedly engaged with the underside of the seat to thereby allow sliding movement of the screw relative to the elongated slot. A leg frame includes two arcuate legs and at least one transverse beam interconnected between the arcuate legs and received in an engaging groove in the seat and secured to two connecting rods, each connecting rod having two ends pivoted to the backrest and the seat, respectively. A a rearward pivotal movement of the backrest relative to the seat causes the seat to move upwardly and forwardly to thereby provide increased safety for the user.

4 Claims, 8 Drawing Sheets

CHAIR WITH ADJUSTABLE INCLINATION

BACKGROUND OF THE INVENTION

The present invention relates to a chair with adjustable inclination to provided increased comfort and safety as well as easy storage.

FIG. 7 of the drawings illustrates a conventional chair which is integrally formed of plastic material and includes a seat back 11', a seat 12' and four legs 13'. Chairs of this type can be stacked for storage. The user sitting on the chair may feel uncomfortable as the seat 12' and the seat back 11' are fixed relative to each other and thus cannot adjust the inclination angle therebetween.

FIG. 8 illustrates a chair which includes a seat 23', a backrest 21' attached to the seat 23' by a post 22', a chassis 24', a frame 25', and a rod 251' connected between the seat 23' and the frame 25'. The inclination angle between the seat 23' and the backrest 21' is adjustable by an adjusting arrangement of the chassis 24' which consists of numerous elements and is time-consuming in assembly. In addition, the chair of this type cannot be stacked for storage. Further, the seat 23' cannot move response to inclination of the backrest 21' due to rigid connection with the chassis 24'. As a result, the user on the chair may fall if the backrest 21' is subjected to a relatively large force from the user's back and thus suddenly moves rearward.

The present invention aims to overcome these difficulties and to provide an improved chair which mitigates and/or obviates the above problems.

SUMMARY OF THE INVENTION

A chair in accordance with the present invention comprises:

a substantially L-shaped backrest including a horizontal section with an underside having a front end and a rear end, the underside of the horizontal section including a first engaging section defined in the front end thereof, the engaging section including a connecting plate with an elongated slot defined therein, the first engaging section further including two first guiding grooves defined therein and extending in a longitudinal direction of the horizontal section, a seat including an underside with a front end and a rear end, the rear end of the underside of the seat including a second engaging section for engaging with the first engaging section of the backrest, the rear end of the underside of the seat including two second guiding grooves extending in a longitudinal direction of the seat, the underside of the seat further including at least one engaging groove defined in a mediate section thereof, a spring assembly including a knob with a screw extending through the elongated slot in the underside of the backrest and threadedly engaged with the underside of the seat to thereby allow sliding movement of the screw relative to the elongated slot, the spring assembly further including a spring mounted around the screw, two connecting rods each having a first end received in an associated said first guiding groove in the backrest and pivoted to the underside of the backrest and a second end received in an associated said second guiding groove in the seat and pivoted to the underside of the seat, and a leg frame including two arcuate legs and at least one transverse beam interconnected between the arcuate legs, said at least one transverse beam being received in said at least one engaging groove in the seat and secured to the connecting rods.

By such an arrangement, a rearward pivotal movement of the backrest relative to the seat causes the seat to move upwardly and forwardly to thereby provide increased safety for the user.

The spring assembly may further include a cover plate mounted to and thus covering the connecting plate of the underside of the backrest. The cover plate includes a second elongated slot in alignment with the first-mentioned elongated slot.

The rear end of the underside of the horizontal section of the backrest includes a stop for engaging with the first ends of the connecting rods to restrain inclination angle of the backrest.

At least one of the arcuate legs includes a stop formed thereon. The stop on the leg frame of an upper chair may engage with the seat of the lower chair to protect the spring assembly of the upper chair from being damaged.

Other objects, advantages, and novel features of the invention will become more apparent from the following detailed description when taken in conjunction with the accompanying drawings.

DESCRIPTION OF THE PREFERRED EMBODIMENT

Figure 1:
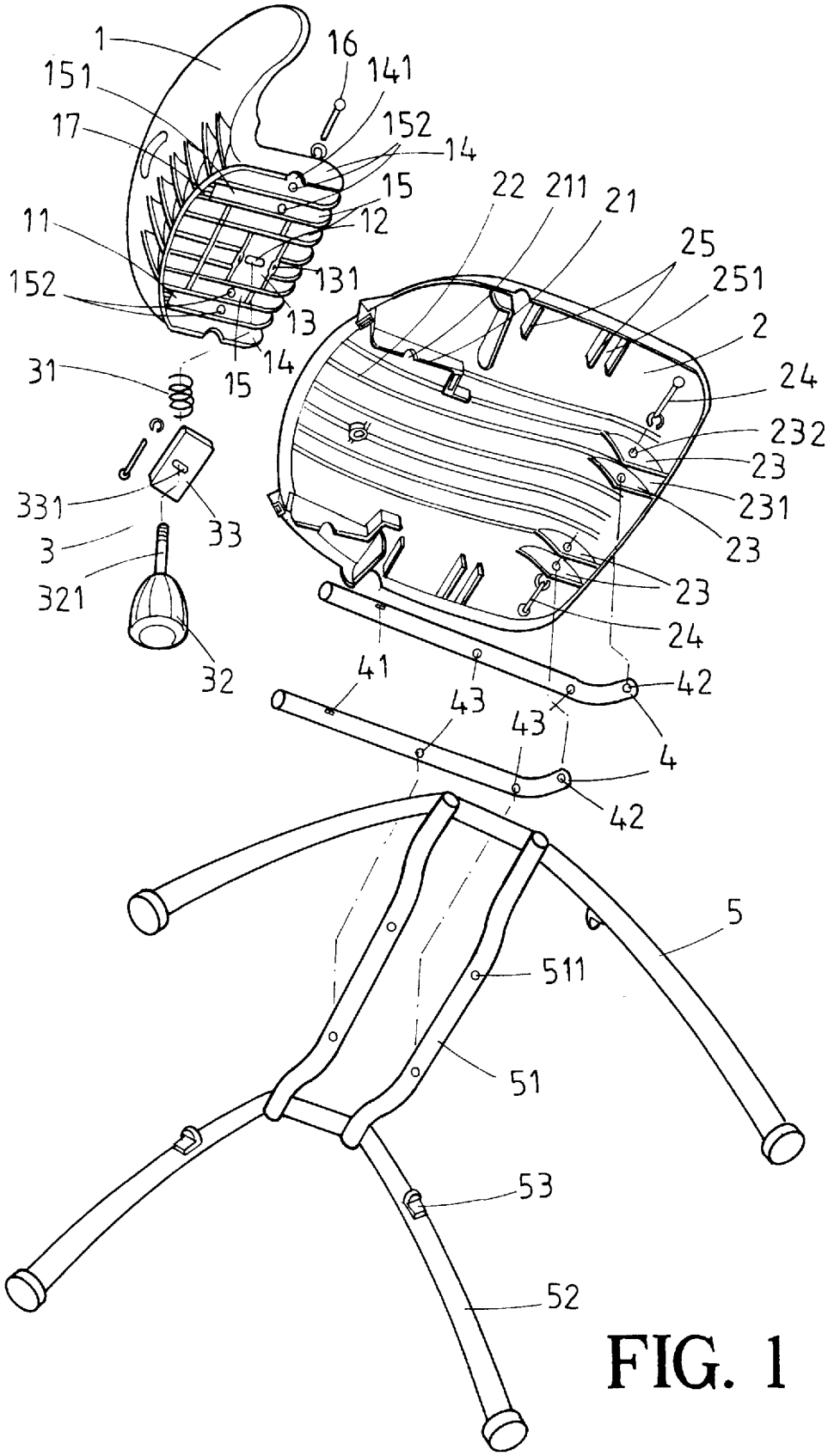
FIG. 1 is an exploded perspective view of a chair in accordance with the present invention.
Figure 2:
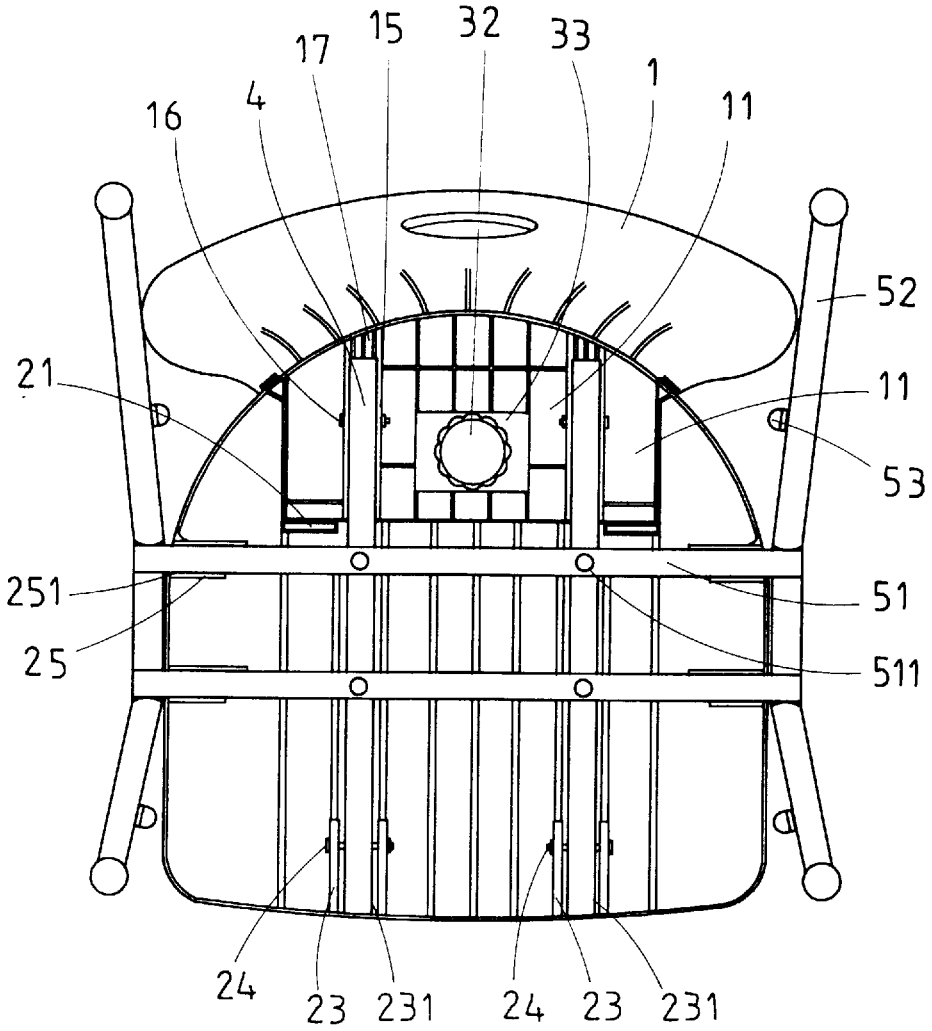
FIG. 2 is a bottom view of the chair in accordance with the present invention.
Figure 3:
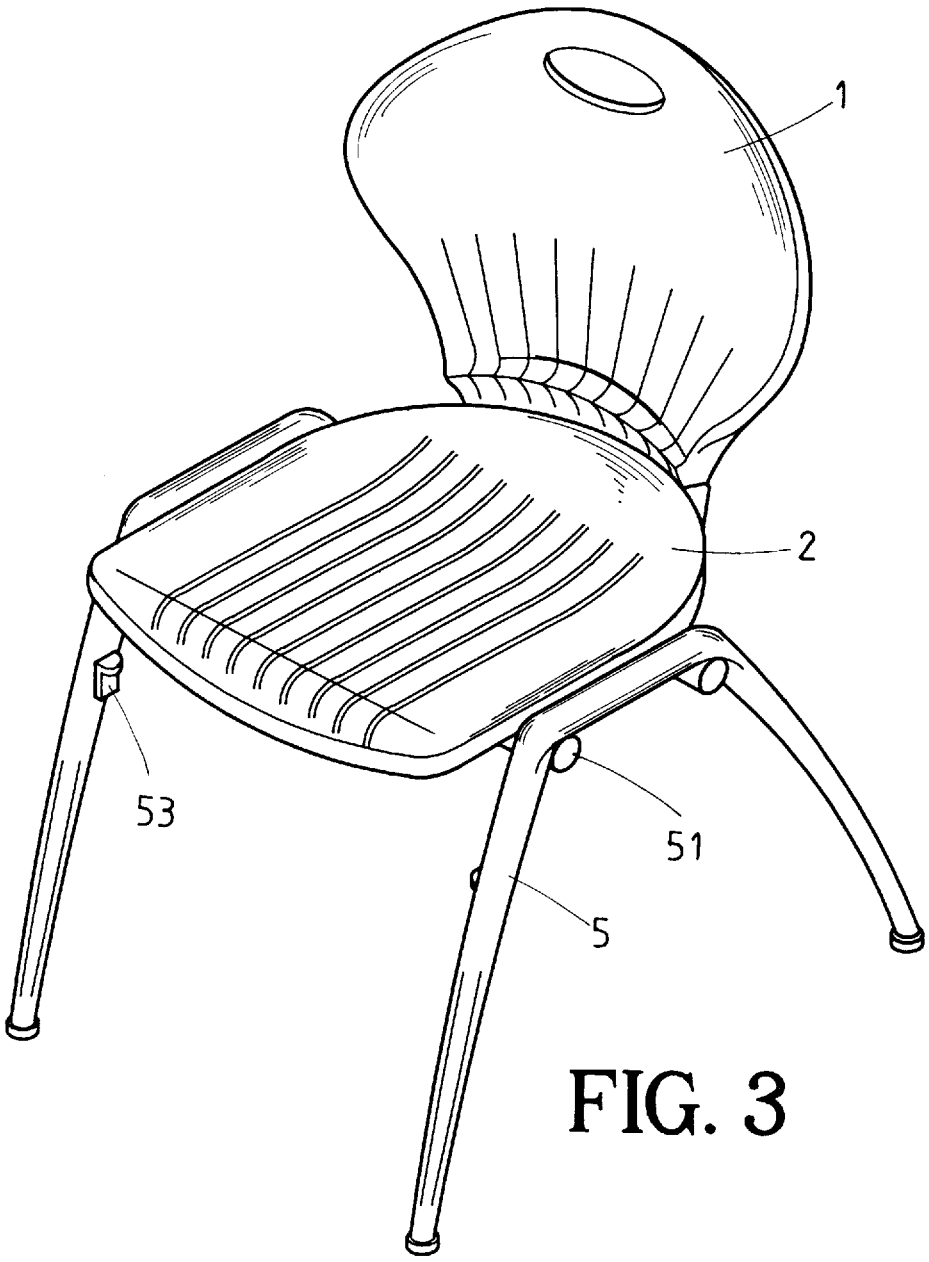
FIG. 3 is a perspective view of the chair in accordance with the present invention.

Referring now to FIGS. 1 to 6 and initially to FIGS. 1 to 3, a chair in accordance with the present invention generally includes a backrest 1, a seat 2, a spring assembly 3, two connecting rods 4, and a leg frame 5. The backrest 1 is substantially L-shaped and includes an engaging section 11 defined in an underside of a horizontal section thereof for engaging with the seat 2. The engaging section 11 includes a connecting plate 13 in which an elongated slot 12 is defined. A screw rod 321 of the spring assembly 3 is extended through the slot 12, which will be described later. The underside of the longitudinal section of the backrest 1 includes a reinforcing rib 14 and a mount piece 15 formed on each side thereof. The mount piece 15 includes two engaging grooves 151 extending in a longitudinal direction of the horizontal section for receiving the connecting rods 4. In addition, each rib 14 includes a hole or notch 141 while each mount piece 15 includes a hole 152 through which a pin 16 is extended. A stop 17 is provided to each engaging slot 151 with which the associated connecting rod 4 is engagable so as to restrain the inclination angle of the backrest 1.

The seat 2 includes an engaging section 22 defined in a rear end of an underside thereof for engaging with the engaging section 11 of the backrest 1. The rear end of the underside of the seat 2 further includes a connecting piece 21 formed on each of two sides thereof and having a hole or notch 211 through which the pin 16 is extended. A hollow stub 221 with inner threading is provided in a mediate section of the engaging section 22 for engaging with the screw rod 321 of the spring assembly 3. Further, two pairs of guiding pieces 23 are provided to a front end of the underside of the seat 2. Each pair of guiding pieces 23 define a guiding groove 231 extending in a longitudinal direction of the seat 2 for securely receiving a portion of the associated connecting rod 4, and pins 24 are extended through holes 232 defined in the guiding pieces 23 and the rods 4. The underside of the seat 2 further includes engaging plates 25 formed on each of two sides thereof, the engaging plates 25 including engaging grooves 251 defined therebetween for receiving transverse beams 51 of the leg frame 5.

The spring assembly 3 includes a spring 31, a knob 32, and a cover plate 33. The knob 32 includes a screw 321 formed on a end thereof, and the cover plate 33 is mounted to and thus covers the connecting plate 13 to provide an esthetically pleasing outlook and includes an elongated hole 331 in alignment with the hole 12 in the connecting plate 13. The screw 321 is extended through the holes 12 and 331 to engage with the stub 221 on the underside of the seat 2, while the spring 31 is mounted around the screw 331 to allow the seat 1 to swivel.

The connecting rods 4 are mounted to the underside of the seat 2 and each of which includes holes 41, 42 defined in two ends thereof so as to be pivotally connected to the backrest 1 and the seat 2, respectively. Each connecting rod 4 further includes a number of holes 43 defined in a mediate section thereof for engaging with the transverse beams 51 on the leg frame 5.

The leg frame 5 includes two arcuate legs 52 connected by the transverse beams 51. Each transverse beam 51 includes holes 511 for engagement with the connecting rods 4. Each arcuate leg 52 includes a stop 53 formed thereon to provide increased stability when the chairs are stacked.

Figure 4:
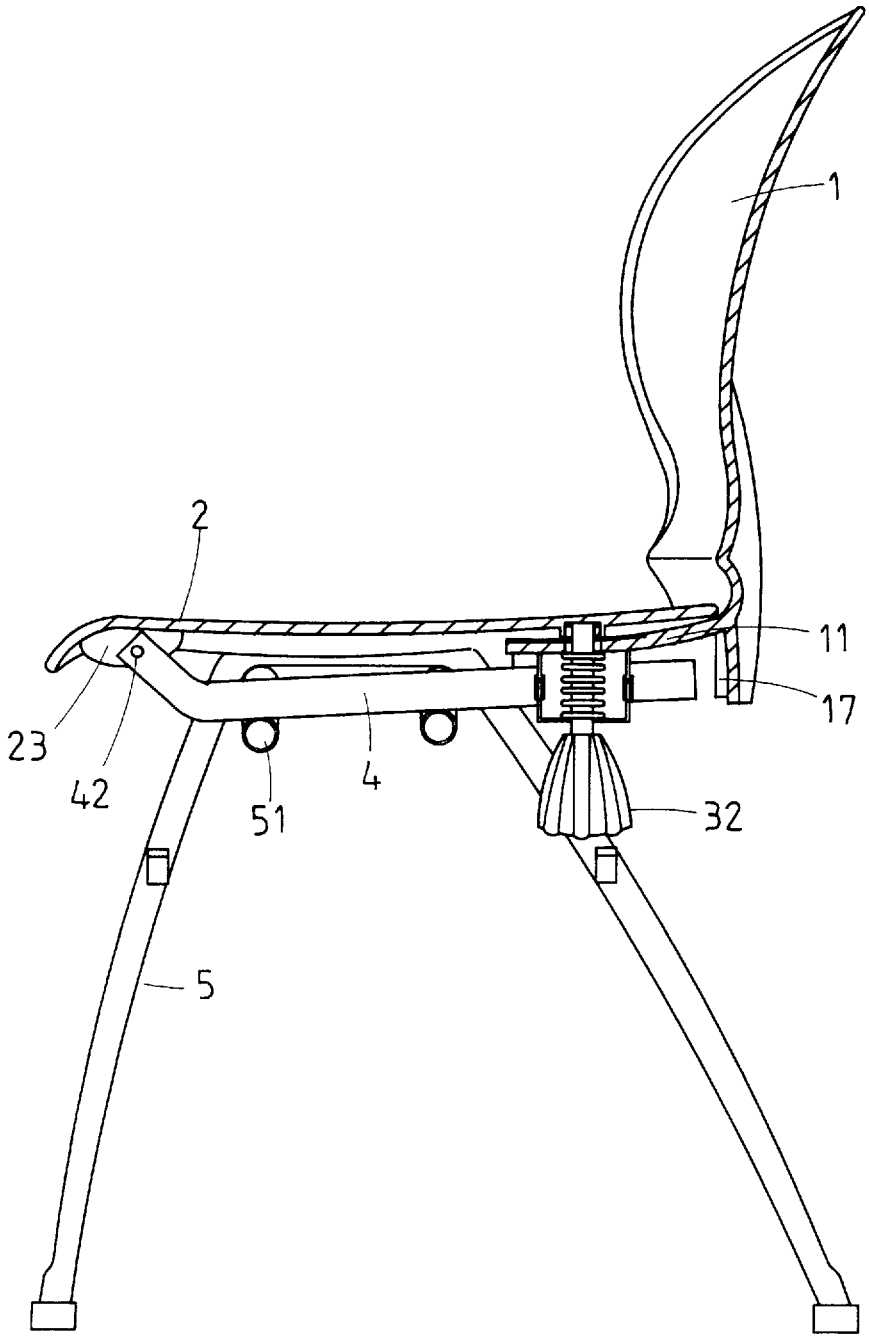
FIG. 4 is a sectional view of the chair in accordance with the present invention.
Figure 5:
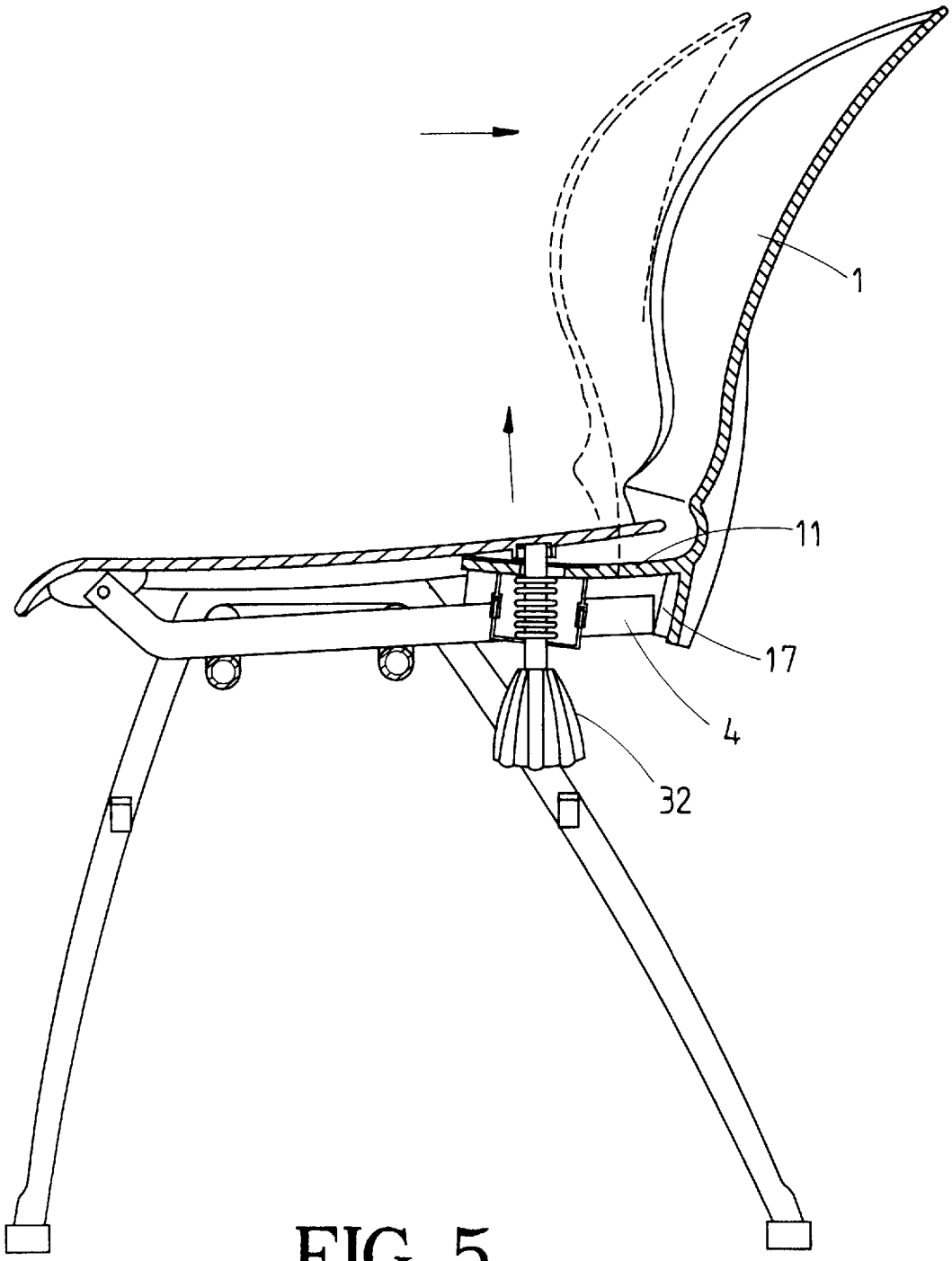
FIG. 5 is a sectional view illustrating operation of the chair in accordance with the present invention.

Referring to FIGS. 4 and 5, when a user sits on the seat 2 with his back resting on the backrest 1, the backrest 1 moves from a position shown by phantom lines to a position shown by solid lines in FIG. 5, thereby providing increased comfort under the action of the spring assembly 3. In addition, the engaging section 11 of the backrest 1 moves upwardly and thus bears against the engaging section 22 of the seat 2. As a result, the front end of the seat 2 moves upwardly relative to the connecting rods 4, and the screw rod 321 is moved from first ends of the holes 12 and 331 to second ends of the holes 12 and 331. This provides a stable gravity for the user as the seat 2 moves forwardly when the backrests 1 inclines rearwardly. Further, the stop 17 on the backrest 1 contacts and thus stopped by rear ends of the connecting rods 4 to restrain the inclination angle of the backrest 1 which provides increased safety for the user.

Figure 6:
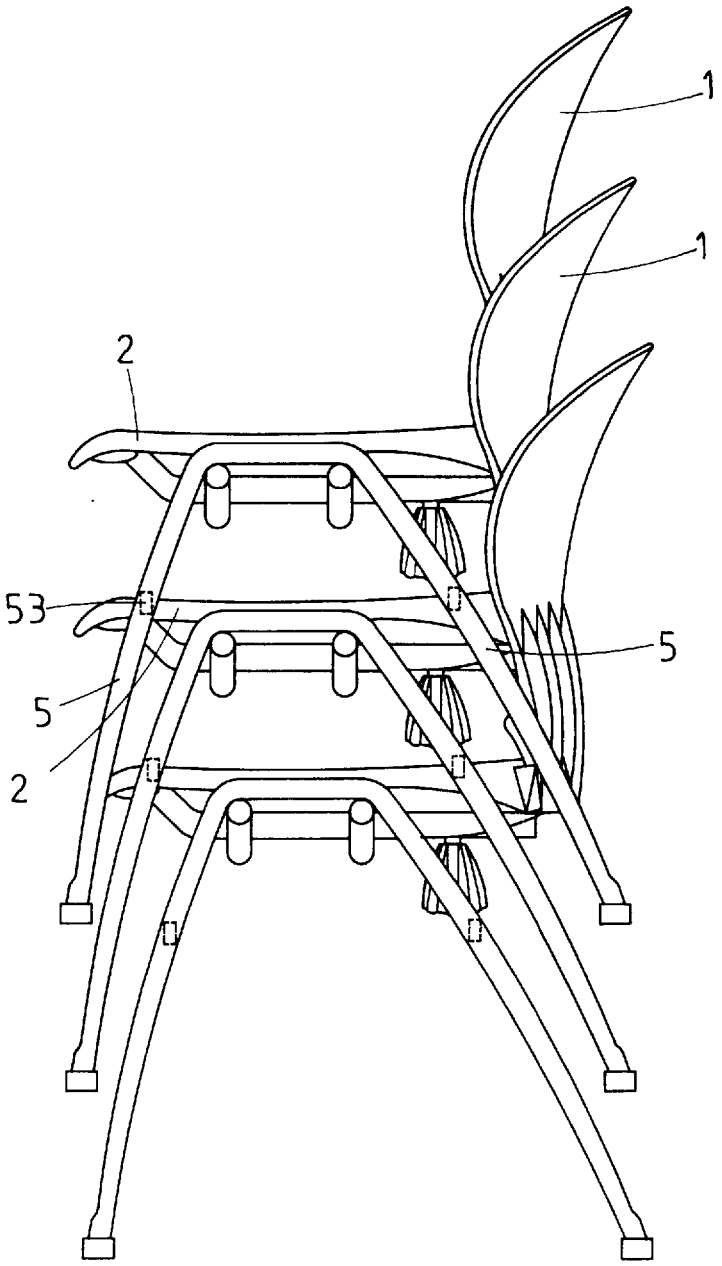
FIG. 6 is a side view illustrating stacking of the chairs in accordance with the present invention.
Figure 7:
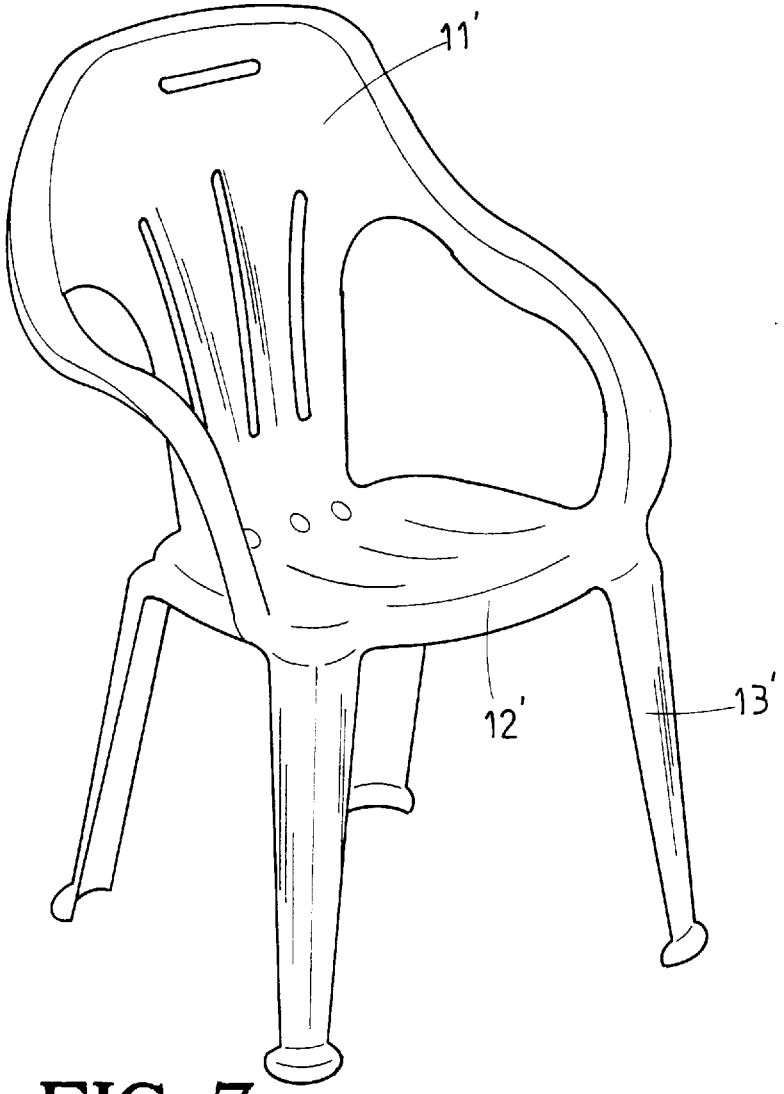
FIG. 7 PRIOR ART
FIG. 7 is a perspective view of a plastic chair according to prior art.
Figure 8:
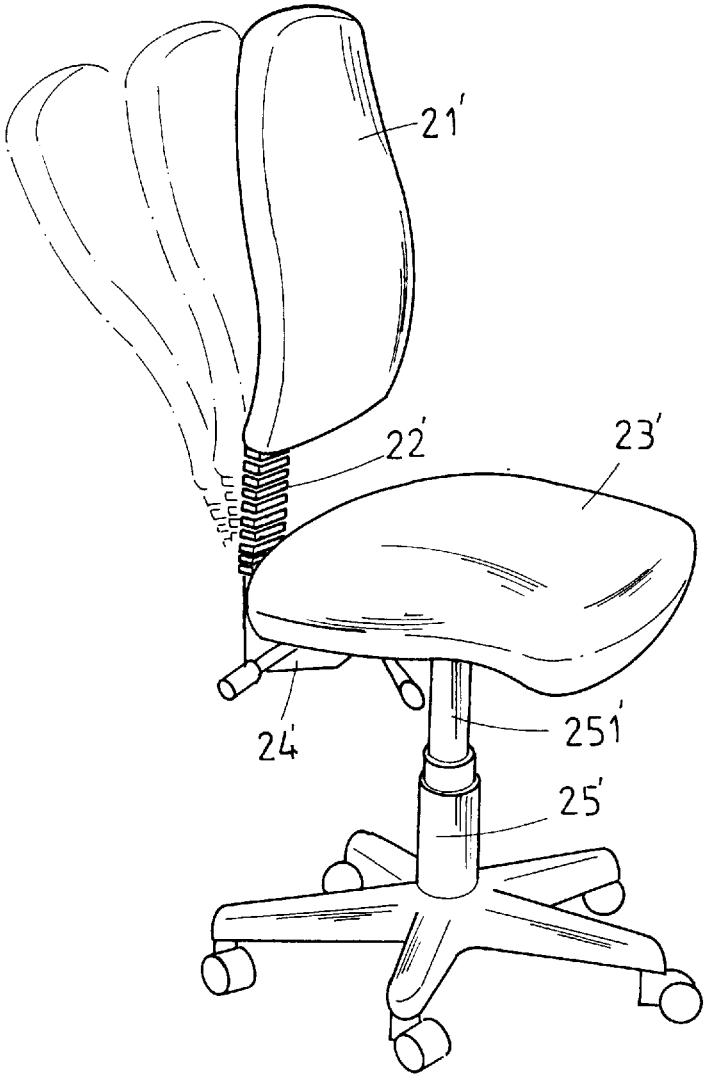
FIG. 8 PRIOR ART
FIG. 8 is an adjustable chair according to prior art.

Referring to FIG. 6, the chairs constructed in accordance with the present invention may be stacked for convenient storage. The stops 53 on the leg frame 5 of an upper chair may engage with the seat 2 of the lower chair to protect the spring assembly 3 of the upper chair from being damaged.

According to the above description, it is appreciated that the chair in accordance with the present invention may provide increased comfort for the user as the backrest may swivel back and forth. In addition, the seat may move slightly upward and forward to cause the center of gravity of the buttock to shift forwardly when the backrest moves rearwardly to thereby provide increased safety. Further, stops are provided on the backrest to strain inclination angle of the backrest to thereby provide increased safety. Further, the chairs can be stacked to minimize the storage volume, and stops are also provides on the leg frames to stable the stacked chairs.

Although the invention has been explained in relation to its preferred embodiment, it is to be understood that many other possible modifications and variations can be made without departing from the spirit and scope of the invention as hereinafter claimed.

What is claimed is:

1. A chair, comprising:

a substantially L-shaped backrest including a horizontal section with an underside having a front end and a rear end, the underside of the horizontal section including a first engaging section defined in the front end thereof, the engaging section including a connecting plate with an elongated slot defined therein, the first engaging section further including two first guiding grooves defined therein and extending in a longitudinal direction of the horizontal section, a seat including an underside with a front end and a rear end, the rear end of the underside of the seat including a second engaging section for engaging with the first engaging section of the backrest, the rear end of the underside of the seat including two second guiding grooves extending in a longitudinal direction of the seat, the underside of the seat further including at least one engaging groove defined in a mediate section thereof, a spring assembly including a knob with a screw extending through the elongated slot in the underside of the backrest and threadedly engaged with the underside of the seat to thereby allow sliding movement of the screw relative to the elongated slot, the spring assembly further including a spring mounted around the screw, two connecting rods each having a first end received in an associated said first guiding groove in the backrest and pivoted to the underside of the backrest and a second end received in an associated said second guiding groove in the seat and pivoted to the underside of the seat, a leg frame including two arcuate legs and at least one transverse beam interconnected between the arcuate legs, said at least one transverse beam being received in said at least one engaging groove in the seat and secured to the connecting rods, whereby a rearward pivotal movement of the backrest relative to the seat causes the seat to move upwardly and forwardly.

2. The chair according to claim 1, wherein the spring assembly further includes a cover plate mounted to and thus covering the connecting plate of the underside of the backrest, the cover plate including a second elongated slot in alignment with the first-mentioned elongated slot.

3. The chair according to claim 1, wherein the rear end of the underside of the horizontal section of the backrest includes a stop for engaging with the first ends of the connecting rods to restrain inclination angle of the backrest.

4. The chair according to claim 1, wherein at least one of the arcuate legs includes a stop formed thereon.

* * * * *